US005691293A

United States Patent [19]

Kruse et al.

[11] Patent Number: 5,691,293

[45] Date of Patent: Nov. 25, 1997

[54] STABLE, DUAL-FUNCTION, PHOSPHATE-, METASILICATE- AND POLYMER-FREE LOW-ALKALI DETERGENT TABLETS FOR DISHWASHING MACHINES AND A PROCESS FOR THEIR PRODUCTION

[75] Inventors: Hans Kruse, Korschenbroich; Hans-Josef Beaujean, Dormagen; Norbert Schaefer; Juergen Haerer, both of Duesseldorf, all of Germany

[73] Assignee: Henkel Kommanditgesellschaft auf Aktien, Duesseldorf, Germany

[21] Appl. No.: 530,114

[22] PCT Filed: Mar. 23, 1994

[86] PCT No.: PCT/EP94/00932

§ 371 Date: Oct. 2, 1995

§ 102(e) Date: Oct. 2, 1995

[87] PCT Pub. No.: WO94/23011

PCT Pub. Date: Oct. 13, 1994

[30] Foreign Application Priority Data

Apr. 1, 1993 [DE] Germany ..... 43 15 048.9

[51] Int. Cl.[6] ..... C11D 7/10; C11D 7/12; C11D 7/42; C11D 7/54

[52] U.S. Cl. ..... 510/224; 510/226; 510/229; 510/374; 510/376; 510/378; 510/446

[58] Field of Search ..... 510/224, 226, 510/229, 374, 376, 378, 446

[56] References Cited

U.S. PATENT DOCUMENTS

| | | | |
|---|---|---|---|
| 4,269,723 | 5/1981 | Barford et al. | 252/106 |
| 4,545,784 | 10/1985 | Sanderson | 8/107 |
| 4,597,886 | 7/1986 | Goedhart et al. | 252/95 |
| 4,839,078 | 6/1989 | Kruse et al. | 252/99 |
| 4,911,858 | 3/1990 | Bunczk et al. | 252/106 |
| 5,055,305 | 10/1991 | Young | 424/466 |
| 5,114,606 | 5/1992 | Van Vliet et al. | 252/103 |
| 5,173,207 | 12/1992 | Drapier et al. | 252/99 |
| 5,344,633 | 9/1994 | Sorensson et al. | 423/333 |
| 5,358,655 | 10/1994 | Kruse et al. | 252/95 |
| 5,407,594 | 4/1995 | Fry et al. | 252/90 |
| 5,468,411 | 11/1995 | Dixit et al. | 252/99 |

FOREIGN PATENT DOCUMENTS

| | | |
|---|---|---|
| 0504091 | 9/1992 | European Pat. Off. . |
| 3541145 | 5/1985 | Germany . |
| 3937469 | 5/1991 | Germany . |
| 4010524 | 10/1991 | Germany . |
| 4121307 | 1/1993 | Germany . |
| 89210121 | 6/1989 | Japan . |
| 9209680 | 6/1992 | WIPO . |
| 9218604 | 10/1992 | WIPO . |
| 9300419 | 1/1993 | WIPO . |
| 9302510 | 9/1993 | WIPO . |

OTHER PUBLICATIONS (method cf. Ritschel, Die Tablette, Ed. Cantor, 1966, p. 313).

*Primary Examiner*—Douglas J. McGinty
*Assistant Examiner*—Gregory R. Delcotto
*Attorney, Agent, or Firm*—Ernest G. Szoke; Wayne C. Jaeschke; Real J. Grandmaison

[57] ABSTRACT

A stable, dual-function, phosphate-, metasilicate- and polymer-free low alkali detergent tablet containing: (a) from 5 to 50% by weight of a sodium citrate; (b) from 1 to 60% by weight of anhydrous sodium carbonate; (c) from 1 to 60% by weight of sodium hydrogen carbonate; (d) a bleaching agent selected from the group consisting of sodium perborate monohydrate, sodium percarbonate and mixtures thereof; (e) from 0.5 to 4% by weight of tetraacetyl ethylenediamine; (f) from 0.1 to 2% by weight of protease; (g) from 0.1 to 2% by weight of amylase; and (h) from 3 to 10% by weight of water, all weights being based on the weight of the tablet.

18 Claims, No Drawings

STABLE, DUAL-FUNCTION, PHOSPHATE-, METASILICATE- AND POLYMER-FREE LOW-ALKALI DETERGENT TABLETS FOR DISHWASHING MACHINES AND A PROCESS FOR THEIR PRODUCTION

BACKGROUND OF THE INVENTION

1. Field of the Invention

Machine dishwashing generally consists of a prerinse cycle, a main wash cycle, one or more intermediate rinse cycles, a final rinse cycle and a drying cycle. This applies both to domestic and to institutional dishwashing machines.

Hitherto, it has mainly been standard practice in the case of domestic dishwashing machines, hereinafter referred to as DDWM, to place the detergent in a dispensing compartment which is generally located in the door of the machine and which automatically opens at the beginning of the main wash cycle. The preceding prerinse cycle is completed without any active substance, i.e. solely with the inflowing tap water.

In institutional dishwashing machines, hereinafter referred to as IDWM, the so-called precleaning zone corresponds in principle to the prerinse cycle of a DDWM. In dishwashing machines for large kitchens, the detergent added to the main wash zone carries over into the precleaning zone where it is used to support the removal of adhering food remains. Although there are IDWM where the precleaning zone is only fed with fresh water, a precleaning zone where detergent is added is more effective than precleaning with freshwater alone.

The principle by which the precleaning zone operates in IDWM has already been applied to DDWM, enabling detergents to be added during the prerinse cycle by introduction in tablet form and positioning of one or more suitable tablets, for example, in an unoccupied part of the cutlery basket or even elsewhere in the machine, so that they could act both during the prerinse cycle and in the actual wash cycle, i.e. could perform a dual function.

2. Discussion of Related Art

The use of such detergent tablets is described, for example, in DE-OS 35 41 145 A1. The tablets in question are detergent tablets of uniform composition with a broad dissolving profile for machine dishwashing which contain typical alkaline-reacting components, more particularly from the group of alkali metal metasilicates and pentaalkali metal triphosphates, active chlorine compounds and tabletting aids, and in which the alkali metal metasilicates consist of a mixture of "sodium metasilicate nonahydrate" ($Na_2H_2SiO_4.8H_2O$) and anhydrous sodium metasilicate while the pentaalkali metal triphosphate consists of anhydrous pentasodium triphosphate, the ratio by weight of anhydrous sodium metasilicate to sodium metasilicate nonahydrate being 1:0.3 to 1:1.5 and the ratio by weight of pentasodium triphosphate to sodium metasilicate—both anhydrous—being from 2:1 to 1:2 and preferably from 1:1 to 1:1.7.

Tablets such as these have such a broad dissolving profile that, even in the prerinse cycle of a DDWM, at least 10% by weight of the tablets can be dissolved by the inflowing tap water, a pH value of at least 10.0 being developed in the wash liquor. Given high solubility in warm water, at least 60% by weight and preferably at least 70% by weight of the tablets are still available for the main wash cycle.

In the context of the invention, the dissolving profile is understood to be the ratio by weight of parts of the tablet dissolved under the conditions of the prerinse cycle of typical DDWM to the tablet as a whole.

However, known tablets contain phosphates which are known to be undesirable.

However, there are also commercially available phosphate-free detergent tablets for dishwashing machines (for example Hui Spül-Tabs, a product of Roth GmbH, Bad Ems) which essentially contain silicates, nonionic surfactants, organic complexing agents and percarbonate. However, when these tablets are placed in the machine (for example in the cutlery basket), they dissolve completely or substantially completely during the actual prerinse cycle, so that hardly any more detergent is available for the main wash cycle. In addition, the stability of these tablets is unsatisfactory.

DE-OS 40 10 524 describes stable, dual-function phosphate-free detergent tablets for dishwashing machines containing silicate, low-foaming nonionic surfactants, organic complexing agents, bleaching agents and water and, in addition, organic complexing agents according to DE-OS 39 37 469 in the form of a granular alkaline detergent additive consisting of sodium salts of at least one homopolymeric or copolymeric (meth)acrylic acid, sodium carbonate, sodium sulfate and water. In the production of these tablets, the granular alkaline additives are mechanically mixed with the other generally powder-form constituents and the resulting mixture is tabletted in known manner.

Following another market trend, DE-OS 41 21 307 provides stable, dual-function, phosphate- and metasilicate-free low-alkali detergent tablets with a broad dissolving profile for dishwashing machines, at least 10% by weight to about 50% by weight of which is dissolved by the tap water flowing into the prerinse cycle of a DDWM, which develops a pH value of at most about 10.5 in the wash liquor and of which at least 50% by weight to around 90% by weight is still available for the main wash cycle by virtue of the high solubility of the tablets in warm water. They contain organic polymers as complexing agents.

To produce these known detergent tablets, the sodium carbonate serving as part of the builders was used in water-free form and, preferably on its own or with the other builders, such as sodium citrate and optionally sodium hydrogen carbonate and the solid alkali metal salts of at least one homopolymeric or copolymeric (meth)acrylic acid, was mixed in a mixing step with the quantity of water required for partial hydration of the water-free sodium carbonate, namely around 5 to 40 and preferably around 7 to 20% by weight, based on the water-free sodium carbonate used as builder, after which the remaining substances were added to the mixture and the mixture obtained was tabletted in a conventional tablet press. The storable tablets thus produced show high resistance to breakage (>140N for a diameter of around 30 to 40 mm and a density of around 1.4 to 1.7 $g/cm^3$) which they retain in storage and which can even be considerably increased in a short time.

In attempts to manage without organic complexing agents by increasing the amounts of sodium citrate and sodium hydrogen carbonate, the tablets obtained were not breakage-resistant. In addition, they were too "readily" soluble, i.e. they dissolve almost completely in the prerinse cycle, so that hardly any more detergent was available for the actual wash cycle.

DESCRIPTION OF THE INVENTION

Now, the present invention relates to stable, dual-function, phosphate-, metasilicate- and now also polymer-free, low-alkali detergent tablets for dishwashing machines which are characterized in that they contain sodium citrate, other builders, enzymes and optionally bleach activators, nonionic surfactants, dyes and fragrances. The correspond to the following starting formulation:

| Constituents | Range | Preferred range |
|---|---|---|
| Trisodium citrate dihydrate | 5–50% | 20–30% |
| Nitrilotrisodium acetate | 0–25% | 0–20% |
| Sodium phosphonate | 0–10% | 0–5% |
| Sodium carbonate, water-free | 1–60% | 1–20% |
| Sodium disilicate | 0–60% | 2–30% |
| Sodium hydrogen carbonate | 1–60% | 30–50% |
| Sodium perborate monohydrate and/or | 0–15% | 5–12% |
| Sodium percarbonate | 0–20% | 5–15% |
| Tetraacetyl ethylenediamine | 0.5–4% | 2–4% |
| Nonionic surfactant | 0–4% | 0.5–2% |
| Protease | 0.1–2% | 0.5–1.5% |
| Amylase | 0.1–2% | 0.5–1.5% |
| Fragrance | 0–1% | 0.1–0.6% |
| Paraffin oil | 0–3% | 0–1.5% |
| Glyceride mixture | 0–6% | 1–4% |
| Water | 3–10% | 4–6% |

A process for the production of these stable, dual-function, phosphate-, metasilicate- and now also polymer-free, low-alkali detergent tablets for dishwashing machines containing sodium citrate, other builders, low-foaming surfactants, bleaching agents and optionally enzymes, bleach activators, fragrances and dyes has been found and is characterized in that sodium citrate dihydrate and/or sodium citrate is/are first moistened with a small quantity of water of around 3 to 10% by weight and preferably around 4 to 6% by weight, based on the composition as a whole, after which water-free sodium carbonate is dusted on and sodium hydrogen carbonate and the bleach activator are then added, enzymes, nonionic surfactants, fragrances/dyes and optionally paraffin oil are introduced and, finally, the active oxygen compound is incorporated with minimal introduction of energy and the overall mixture thus obtained is tabletted in a conventional tablet press at a relative air humidity level of around 15 to 60% and preferably around 20 to 30% under a pressure of around 2 to 11 and preferably around 4 to 6 MPa.

The optional paraffin oil may even be added at the same time as the sodium citrate, preferably in the form of a mixture which is prepared in a preceding separate mixing step from preferably 1 to 3% by weight and, more particularly, around 2% by weight of paraffin oil, based on the overall detergent mixture, and sodium citrate. It is also of advantage to hydrophobicize the sodium hydrogen carbonate in a preliminary mixing step with paraffin oil.

A desirable further delay in dissolution in the prerinse cycle of a DDWM can be obtained if the water added at the beginning is mixed with the nonionic surfactant, to which the fragrance may also be added, or with a glyceride mixture and sprayed onto the sodium citrate and the remaining substances are then added.

Another preferred embodiment of the process according to the invention is characterized in that all the liquid components of the composition are first applied to the sodium citrate, after which the water-free sodium carbonate is dusted on and sodium hydrogen carbonate, the bleach activator and, finally, the active oxygen compound are successively introduced, each with minimal introduction of energy, and the overall mixture thus obtained is tabletted as described above. By "minimal introduction of energy" is meant moderate mixing without the high-speed cutter heads and with only short residence times in the mixer.

The storable tablets produced in accordance with the invention have a high breakage resistance (>140N for a diameter of around 30 to 40 mm and a density of around 1.4 to 1.7 g/cm$^3$) which can be considerably increased in a short time during storage and which they also retain in storage.

Besides sodium citrate and alkali metal hydrogen carbonates and/or alkali metal carbonates, suitable builders are alkali metal nitrilotriacetates, alkali metal phosphonates and alkali metal disilicates. They bind hardness salts, such as calcium and magnesium ions, from the water and from food remains by complexing or dispersion and thus prevent the formation of line coatings on the dishwashing machine and its contents. They may be used as water-free salts and/or as hydrate salts. The sodium citrate used may be water-free trisodium citrate or trisodium citrate dihydrate. The alkali metal carbonate is preferably sodium carbonate of any quality, for example calcined soda or compacted soda. The sodium hydrogen carbonate used may be of any origin. The preferred alkali metal phosphonate is the tetrasodium salt of 1-hydroxyethane-1,1-diphosphonic acid (Turpinol® 4 NZ, a product of Henkel KGaA). Dried waterglass with an $SiO_2$ to $Na_2O$ ratio of 1:2–2.5 (for example Portil® A or AW, products of Henkel KGaA, Britesil® H 24 or C 24, products of Akzo) is suitable as the sodium disilicate.

Preferred low-foaming surfactants, which are used to promote the separation of fat-containing food remains and as tabletting aids, are extremely low-foaming nonionic compounds, preferably $C_{12-18}$ alkyl polyethylene glycol/polypropylene glycol ethers containing up to 8 moles of ethylene oxide and 8 moles of propylene oxide units in the molecule. In general, they make up about 0.2 to 5% by weight and preferably about 0.5 to 3% of the total weight of the tablets. However, it is also possible to use other nonionic surfactants known as low foamers, such as for example $C_{12-18}$ alkyl polyethylene glycol/polybutylene glycol ethers containing up to 8 moles of ethylene oxide and 8 moles of butylene oxide units in the molecule, in which case about 0.2 to 2% by weight and preferably about 0.2 to 1% by weight, based on the tablet as a whole, of foam inhibitors such as, for example, silicone oils, mixtures of silicone oil and hydrophobicized silica, paraffin oil/Guerbet alcohols and hydrophobicized silica may optionally be added.

Nowadays, active oxygen carriers as bleaches are typical constituents of detergents for DDWM. Bleaches such as these include above all sodium perborate monohydrate and tetrahydrate and also sodium percarbonate and sodium caroate. Since active oxygen on its own only develops its full effect at elevated temperatures, so-called bleach activators are used to activate it at around 60° C., i.e. the temperature of the main wash cycle in DDWM. Preferred bleach activators are TAED (tetraacetylenediamine), PAG (pentaacetyl glucose), DADHT (1,5-diacetyl-2,4-dioxohexahydro-1,3,5-triazine) and ISA (isatoic anhydride).

The separation of protein-containing and starch-containing food remains can be improved by the use of enzymes, such as proteases and amylases, for example proteases, such as BLAP®, a product of Henkel KGaA, Optimase® M-440, Optimase® M-330, Opticlean® M-375, Opticlean® M-250, products of Solvay Enzymes, Maxacal® CX 450,000, Maxapem®, products of Ibis, Savinase® T, a product of Novo, or Esperase® T, a product of Ibis, and amylases, such as Termamyl® 60 T, 90 T, products of Novo, Amylase-LT®, a product of Solvay Enzymes, or Maxamyl® P 5000, a product of Ibis.

Typical oxidation-stable dyes and fragrances may also be added to the tablet mixtures. For aesthetic reasons, the tablets may even be pressed in colored layers for otherwise the same composition.

The use of tabletting aids, such as mold release agents, for example paraffin oil, or mixtures of mono-, di- and triglycerides of $C_{12-18}$ and preferably $C_{16-18}$ fatty acids, for example commercial glyceride mixtures marketed as baking aids, such as Boeson VP (a product of Boehringer, Ingelheim), is not necessary in the production of the tablets according to the invention and may generally be omitted providing the tabletting mixtures contain nonionic surfactants which largely perform this function. Nevertheless, the addition of paraffin oil and/or glyceride mixtures can be useful, as indicated above, because it delays the dissolving of the tablets with the result that a higher percentage of the tablet is available in the wash cycle. The required pH value is preferably established through the sodium hydrogen carbonate component.

The mixture produced as described above is tabletted in conventional tablet presses under a pressure of around 2 to 11 MPa and preferably around 4 to 6 MPa. The tabletting process may be carried out in known manner without lubrication in commercial eccentric presses, hydraulic presses or rotary presses. The tabletting mixture does not adhere to the tabletting tools. Tools coated with rigid plastic and also uncoated tools give tablets with smooth surfaces, so that in most cases there was no need to coat the punches with soft plastic.

The tabletting conditions were optimized to establish the desired dissolving profile and, at the same time, adequate tablet hardness. The flexural strength of the tablets may be used as a measure of their hardness (method: cf. Ritschel, Die Tablette, Ed. Cantor, 1966, page 313). Under simulated transport conditions, tablets having a flexural strength of greater than 100N and preferably greater than 150N are classified as sufficiently stable. The flexural strength or breakage resistance of the tablets may be controlled irrespective of their format through the degree of compression, i.e. the tabletting pressure.

Corresponding tablet hardnesses were achieved under the tabletting pressures mentioned above. Differences in solubility could be equalized within limits by varying the tabletting pressure for different compositions.

The specific gravity of the tablets was between about 1.2 and 2 g/cm$^3$ and preferably between about 1.4 and 1.8 g/cm$^3$. The compression applied during the tabletting process produced changes in density which increased from about 0.4 to 1.2 g/cm$^3$ and preferably from about 0.6 to 1.0 g/cm$^3$ to about 1.2 to 2.0 g/cm$^3$ and preferably to about 1.4 to 1.6 g/cm$^3$.

The shape of the tablet can also influence its resistance to breakage and its dissolving rate through the outer surface exposed to the attack of the water. For stability reasons, cylindrical tablets with a diameter-to-height ratio of about 0.6 to 4.0:1 were produced.

To measure their resistance to breakage, the tablets were loaded by a wedge. The resistance to breakage corresponds to the weight of the wedge-like load which leads to breakage of the tablet.

The quantities of the mixture to be tabletted for the individual tablets may be varied as required within technically reasonable limits. Depending on the size of the tablets, preferably 1 to 2 or even more tablets are used per machine filling to provide the dishwashing process as a whole with the necessary active substance content of detergent. Tablets weighing 20 to 40 g for a diameter of about 35 to 40 mm, which are used one at a time, are preferred.

If the sodium carbonate was not hydrated or was used in the form of a full hydrate, the quality of the tablets obtained from the mixture did not meet commercial standards because the tablets showed inter alia inadequate breaking resistance. In addition, the mixtures caked on the top force of the presses during tabletting.

EXAMPLES

Example A

A 50 kg mixture was prepared in a 130 1 Lödige plowshare mixer by initially spraying 4 parts by weight of water onto 7.5 parts by weight of sodium carbonate and 48 parts by weight of sodium hydrogen carbonate and then mixing 60 parts with 30 parts by weight of sodium citrate dihydrate, 2 parts by weight of TAED granules, 1 part by weight of BLAP® 170 and 1 part by weight of Termamyl® while 0.9 part by weight of Dehydol LS4 and 0.6 part by weight of fragrance were sprayed on. 5 Parts by weight of perborate monohydrate were then carefully added to the mixture obtained. This can be seen from the Table showing the tabletting conditions and the tablet properties, the tablets obtained with this mixture lacked breakage resistance and dissolved too quickly in the prerinse cycle.

Example 1

For the same composition as described in Example A, the sodium citrate dihydrate was first sprayed with water in accordance with the invention in a 130 liter Lödige mixer and then dusted with soda. TAED granules, sodium hydrogen carbonate, BLAP 170, Termamyl 60 T and a mixture of perborate monohydrate, fragrance and Dehydol LS4 were then added. The considerably more favorable properties of the tablets thus obtained both in this Example and in the following Examples are apparent from the following Tables.

Example 2

The mixture was prepared as in Example 1, except that the perborate monohydrate was separately added last of all following addition of the Dehydol LS4.

Example 3

The mixture was prepared in the same way as described in Example 1 except that, last of all, 1% of paraffin oil was additionally sprayed onto the mixture.

Example 4

A mixture of water, Dehydol LS4 and fragrance was applied to the sodium citrate dihydrate initially introduced into the Lödige plowshare mixer, the whole was dusted with soda and the remaining components were then added.

Example 5

A suspension of 4 parts by weight of water and 4 parts by weight of glyceride mixture (Boeson VP) was applied to the sodium citrate dihydrate initially introduced into the L ödige plowshare mixer, the whole was dusted with soda and the remaining components were then added as in Example 3.

Example 6

The mixture was prepared in the same way as in Example 2 except that Boeson VP was added last of all.

Composition of the Examples

| Raw material | A, 1, 2, 4 | 3 | 5 + 6 |
|---|---|---|---|
| Trisodium citrate dihydrate | 30.0 | 30.0 | 30.0 |
| Sodium carbonate, water-free | 7.5 | 7.5 | 7.5 |
| Sodium hydrogen carbonate | 48.0 | 47.0 | 44.0 |
| Sodium perborate monohydrate | 5.0 | 5.0 | 5.0 |
| TAED granules | 2.0 | 2.0 | 2.0 |
| Dehydol LS4 | 0.9 | 0.9 | 0.9 |
| BLAP 170 | 1.0 | 1.0 | 1.0 |
| Termamyl ® 60 T | 1.0 | 1.0 | 1.0 |
| Boeson VP | — | — | 4.0 |
| Fragrance | 0.6 | 0.6 | 0.6 |
| Paraffin oil | — | 1.0 | — |
| Water | 6.4 | 4.0 | |

TAED = Tetraacetyl ethylenediamine
Dehydol ® LS4 = $C_{12-14}$ fatty alcohol · 4 EO
BLAP ® 170 = Protease
Termamyl ® 60 = Amylase
Boeson VP = Commercial glyceride mixture

TABLE

| Example | | A | 1 | 2 | 3 | 4 | 5 | 6 |
|---|---|---|---|---|---|---|---|---|
| Tablet weight | g | 25 | 25 | 25 | 25 | 25 | 25 | 25 |
| Tablet diameter | mm | 38 | 38 | 38 | 38 | 38 | 38 | 38 |
| Tablet density | g/cm³ | 1.6 | 1.58 | 1.58 | 1.62 | 1.62 | 1.62 | 1.61 |
| Tabletting force | KN | 60 | 60 | 60 | 60 | 60 | 60 | 60 |
| Breakage resistance | | | | | | | | |
| After production | N | 110 | 140 | 140 | 140 | 140 | 140 | 140 |
| After 24 hours | N | 210 | 220 | 360 | 200 | 440 | 420 | 155 |
| Tablet residues | | | | | | | | |
| After prerinse cycle | g | 11 | 18 | 15 | 20 | 18 | 19 | 19 |
| After main wash cycle | g | 0 | 0 | 0 | 0 | 0 | 0 | 0 |

As can be seen, the best results in regard to breakage resistance and the required dissolving profile were obtained when liquid mixtures or suspensions of formulation ingredients were first applied to the sodium citrate and the remaining solid constituents were then added.

We claim:

1. A stable, dual-function, phosphate-, metasilicate- and polymer-free low alkali detergent tablet consisting essentially of:

(a) from 5 to 50% by weight of a trisodium citrate;

(b) from 1 to 60% by weight of anhydrous sodium carbonate;

(c) from 1 to 60% by weight of sodium hydrogen carbonate;

(d) up to 20% by weight of a bleaching agent selected from the group consisting of sodium perborate monohydrate, sodium percarbonate and mixtures thereof;

(e) from 0.5 to 4% by weight of a tetraacetyl ethylenediamine;

(f) from 0.1 to 2% by weight of a protease;

(g) from 0.1 to 2% by weight of an amylase;

(h) 1 to 4% by weight of glycerides; and (i) from 3 to 10% by weight of water, all weights being based on the weight of said detergent tablet.

2. The detergent tablet of claim 1 wherein said detergent tablet further contains an additive selected from nitrilotrisodium acetate, sodium phosphonate, nonionic surfactant, fragrance, dye, paraffin oil, and mixtures thereof.

3. A detergent tablet as in claim 1 having a specific gravity of from about 1.2 to about 2.0 g/cm³.

4. A detergent tablet as in claim 1 having a flexural strength of at least about 100N.

5. A detergent tablet as in claim 1 wherein said tablet is cylindrical in shape and has a diameter-to-height ratio of from about 0.6:1 to 4.0:1, respectively.

6. A detergent tablet as in claim 2 consisting essentially of from 20 to 30% by weight of trisodium citrate dihydrate, up to 20% by weight of nitrilotrisodium acetate; up to 5% by weight of sodium phosphonate, from 1 to 20% by weight of anhydrous sodium carbonate, from 30 to 50% by weight of sodium hydrogen carbonate, from 5 to 12% by weight of sodium perborate monohydrate, from 2 to 4% by weight of tetraacetyl ethylenediamine, from 0.5 to 2% by weight of nonionic surfactant, from 0.5 to 1.5% by weight of protease, from 0.5 to 1.5% by weight of amylase, from 0.1 to 0.6% by weight of fragrance, up to 1.5% by weight of paraffin oil, from 1 to 4% by weight of glycerides and from 4 to 6% by weight of water, all weights being based on the weight of said detergent tablet.

7. A process for making a stable, dual-function, phosphate-, metasilicate- and polymer-free low alkali detergent tablet comprising the steps of:

(a) providing a starting formulation consisting essentially of:

(i) from 5 to 50% by weight of sodium citrate; and (ii) from 3 to 10% by weight of water, all weights being based on the weight of said starting formulation wherein mono-, di- and triglycerides of $c_{12-18}$ fatty acids are added to said water of step (a) prior to moistening soad sodium citrate;

(b) moistening said sodium citrate with said water to form a moistened sodium citrate component;

(c) dusting said moistened sodium citrate in combination with said triglycerides component with anhydrous sodium carbonate to form a dusted sodium citrate component;

(d) adding sodium hydrogen carbonate and a bleach activator to said dusted sodium citrate component to form a mixture;

(e) adding to said mixture with minimal introduction of energy an active oxygen agent selected from the group consisting of sodium perborate monohydrate, sodium percarbonate, and mixtures thereof; and (f) tabletting the mixture to form a detergent tablet.

8. The process of claim 7 wherein said sodium citrate is sodium citrate dihydrate.

9. The process of claim 7 wherein said sodium hydrogen carbonate of step (d) is hydrophobicized with paraffin oil before being added to said dusted sodium citrate component.

10. The process of claim 7 further including adding to said moistened sodium citrate of step (a) an additive selected from nitrilotrisodium acetate, sodium phosphonate, nonionic surfactant, fragrance, dye, paraffin oil, and mixtures thereof, prior to said dusting step (b).

11. The process of claim 7 wherein said tabletting step (f) is performed at a relative air humidity level of from 15 to 60%.

12. The process of claim 7 wherein said tabletting step (f) is performed at a tabletting pressure of from 2 to 11 mPa.

13. The process of claim 15 wherein said detergent tablet has a specific gravity of from about 1.2 to 2.0 g/cm³.

14. The process of claim 7 wherein said detergent tablet has a flexural strength of at least about 100N.

15. The process of claim 7 wherein said detergent tablet is cylindrical in shape and has a diameter-to-height ratio of from about 0.6:1 to 4.0:1, respectively.

16. The product of the process of claim 7.

17. The product of the process of claim 10.

18. The product of the process of claim 12.

* * * * *